United States Patent [19]

Mehrholz et al.

[11] Patent Number: 5,037,586

[45] Date of Patent: Aug. 6, 1991

[54] UNIVERSALLY MOUNTED HUMIDIFIER

[76] Inventors: John E. Mehrholz, 114 S. Racine, Chicago, Ill. 60607; Thomas L. Rowe, 616 Markel Rd., Channahon, Ill. 60410

[21] Appl. No.: 506,245

[22] Filed: Apr. 9, 1990

[51] Int. Cl.[5] ..... B01F 3/04

[52] U.S. Cl. ..... 261/142; 261/26; 261/97; 261/DIG. 15; 261/DIG. 46; 261/63

[58] Field of Search ..... 261/26, 97, 142, DIG. 15, 261/DIG. 46, 24, 63

[56] References Cited

U.S. PATENT DOCUMENTS

| | | | |
|---|---|---|---|
| 2,144,693 | 1/1939 | Seid | 261/63 |
| 3,171,401 | 3/1965 | McDuffee | 261/DIG. 15 |
| 3,290,020 | 12/1966 | Findley | 261/29 |
| 3,307,835 | 3/1967 | Perlman | 261/29 |
| 3,315,948 | 4/1967 | Martin | 261/DIG. 46 |
| 3,334,471 | 8/1967 | Herron | 261/63 |
| 3,427,005 | 2/1969 | Kuykendall | 261/26 |
| 3,437,318 | 4/1969 | Abbott et al. | 261/24 |
| 3,456,927 | 7/1969 | Martin et al. | 261/DIG. 15 |
| 3,640,265 | 2/1972 | Smart, Sr. | 261/DIG. 46 |
| 3,834,683 | 9/1974 | McDuffee | 261/26 |
| 4,029,723 | 6/1977 | Morrison et al. | 261/DIG. 15 |
| 4,576,013 | 3/1986 | Sperr et al. | 261/DIG. 46 |

*Primary Examiner*—Tim Miles

*Attorney, Agent, or Firm*—Hill, Van Santen, Steadman & Simpson

[57] ABSTRACT

A universally mountable humidifier which can be mounted such that the outlet extends upwardly, downwardly or from a selected sidewall. The humidifier can be mounted in many different orientations and locations. The versatility of the manner of installing it allows it to be adaptable to nearly all environments.

7 Claims, 4 Drawing Sheets

FIG. 1
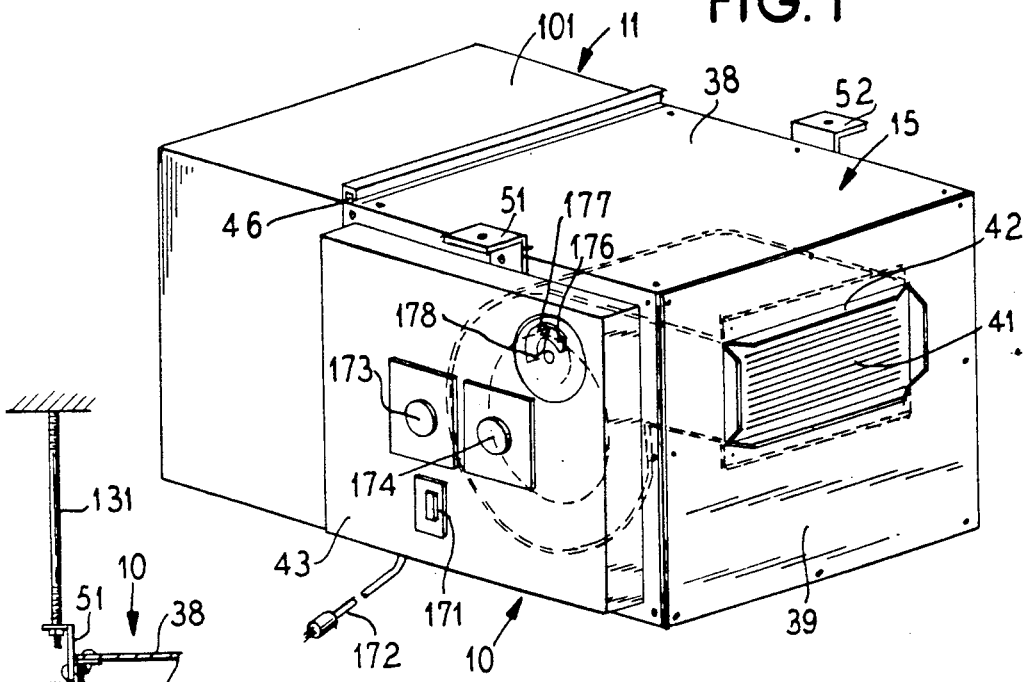
FIG. 10
FIG. 2
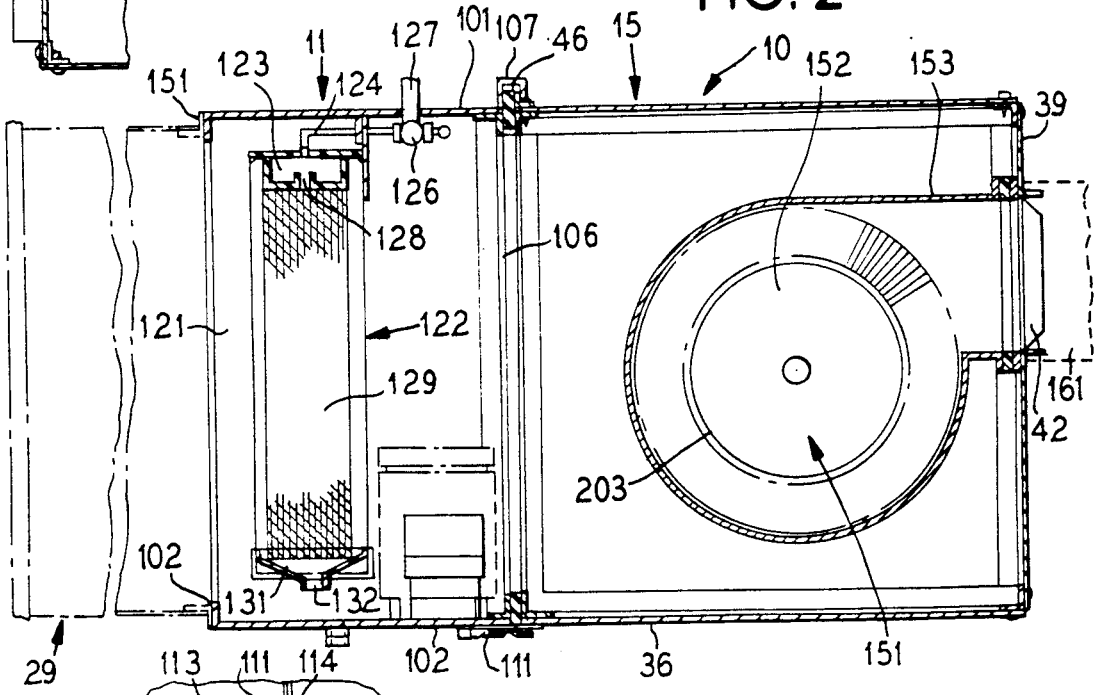
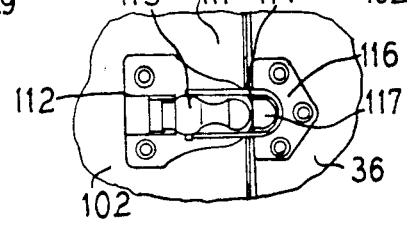
FIG. 11

FIG. 6
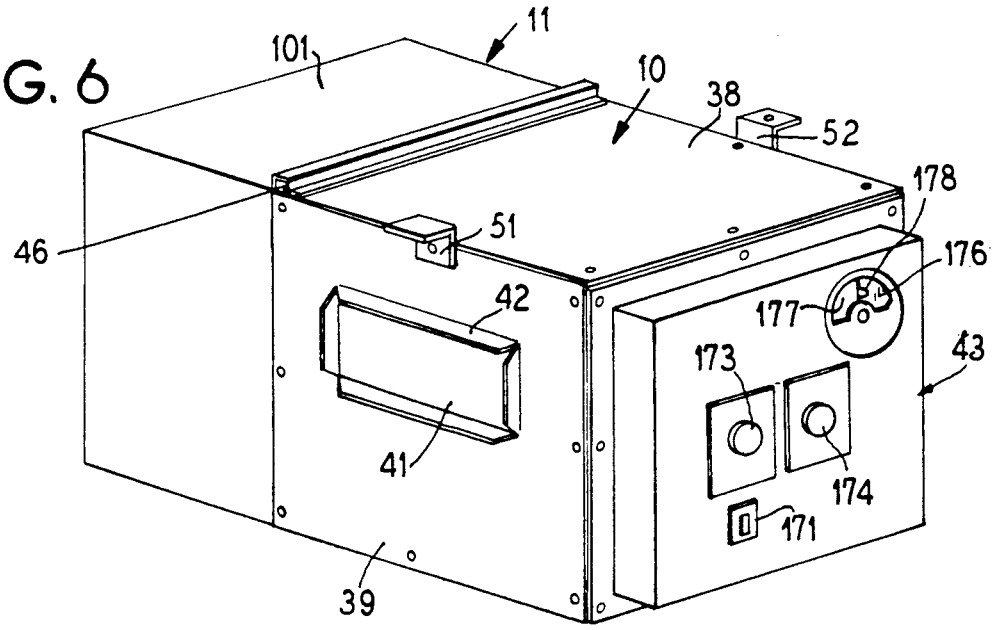
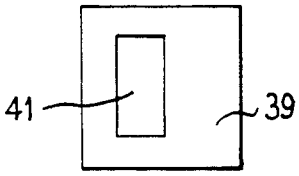
FIG. 7
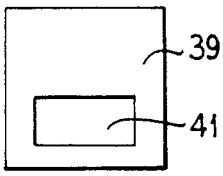
FIG. 8
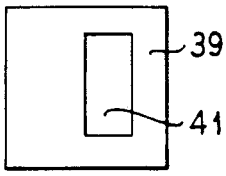
FIG. 9
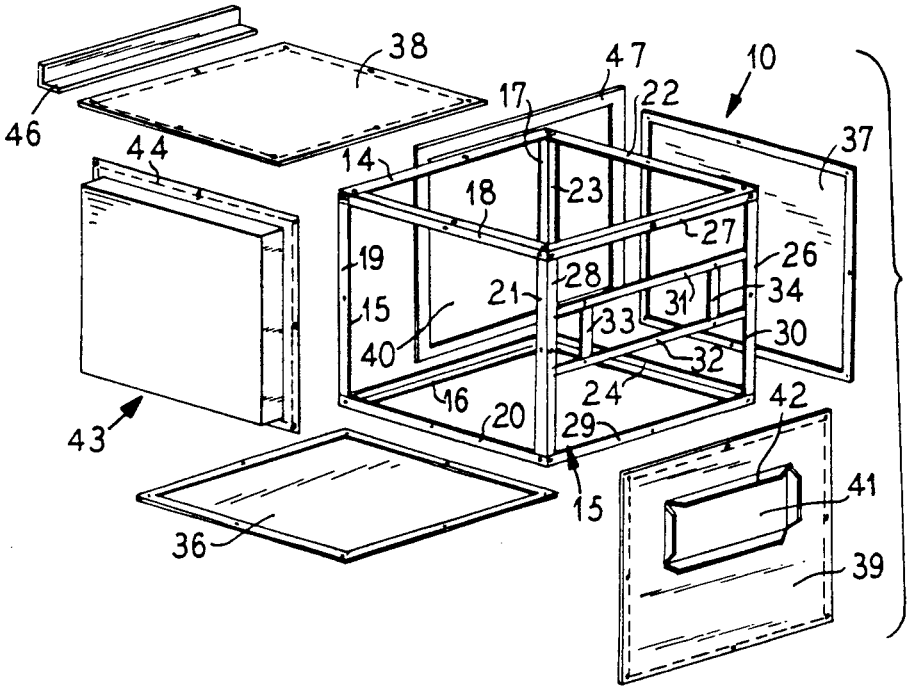
FIG. 3

UNIVERSALLY MOUNTED HUMIDIFIER

BACKGROUND OF THE INVENTION

1. Field of the Invention

This invention relates in general to humidifiers and in particular to a novel humidifier that can be mounted in numerous locations and environments.

2. Description of the Prior Art

In apartments and condominiums where humidifiers are desired, it has normally been necessary to install freestanding units which plug into the power outlet. Such units are noisy, inefficient and detract from the aesthetic setting of the room in which they are installed.

Many apartments and condominiums have limited space for mounting units such as a humidifier.

SUMMARY OF THE INVENTION

The present invention comprises a humidifier which can be mounted in limited and a variety of different shaped spaces in a building such as a condominium or apartment which comprises a centrifugal blower driven by an adjustable speed motor mounted in a cube-shaped module so that an outlet from the blower can be mounted on any selected side of the module such as any of the sidewalls or the top or bottom. A humidifier unit is selectively connectible to the centrifugal blower cube-shaped module and a preheater can be connected to the input of the humidifier. A water supply and drain can be connected to the humidifier and the output of the blower may be connected to the heat ducts to distribute the humidified air. Means are provided for mixing ambient air into the input of the blower, if desired. A drain safety switch may be provided to turn off the unit if the drain becomes clogged and also to remove excess water from the collecting pan. The unit may be connected to a remote digital electronic sensor humidistat having single or multiple stages or may include an integral humidistat in the unit.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

BRIEF DESCRIPTION OF THE DRAWINGS

FIG. 1 is a perspective view of the humidifier of the invention;

FIG. 2 is a side sectional view of the invention;

FIG. 3 is an exploded view of the modular cube unit of the invention in which the centrifugal blower and adjustable speed motor are mounted;

FIG. 6 is a perspective view of the unit showing the panel in a different orientation than that shown in FIG. 1;

FIGS. 7, 8 and 9 show panels in different orientations;

FIG. 10 is an enlarged view showing a support arrangement;

FIG. 11 shows a locking means for joining units together in the invention;

DESCRIPTION OF THE PREFERRED EMBODIMENTS

Figure 4:
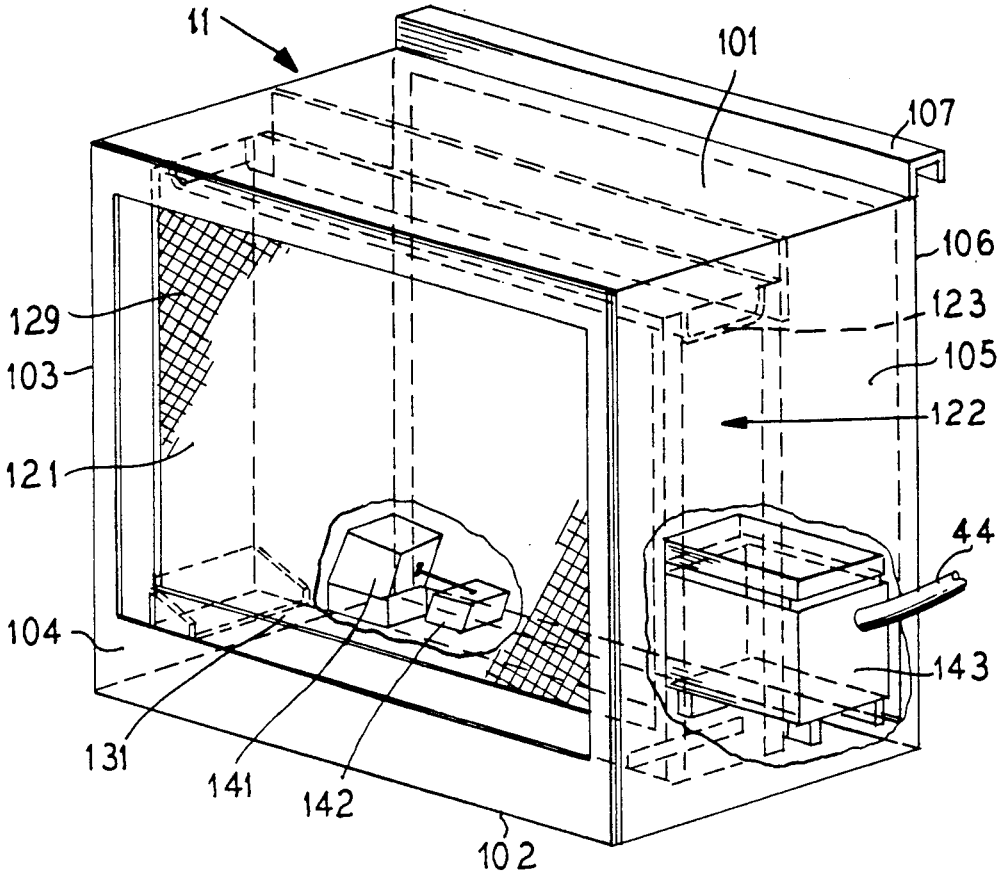
FIG. 4 is a partially cut-away perspective view of the humidifier unit.

The invention comprises a humidifier 10 as shown in FIGS. 1, 2 and 6 which has a cube-shaped motor blower unit 15 and a humidifying section 11. Optionally, a preheater 25, as shown in FIG. 2 can be connected to the humidifying unit 11 so as to preheat the intake air to the unit.

So as to allow the humidifier 10 to be mounted in any orientation as, for example, in condominiums and apartments, the motor blower unit 15 is formed as a cube-shape such that the motor blower outlet 42 can extend from any of the horizontal sides of the unit as well as from the top and bottom. In addition, the orientation of the outlet duct 42 can be mounted in at least four orientations as illustrated in FIGS. 1, 6, 7, 8 and 9, for example, by rotating the output duct panel 39 relative to the cube unit 15. The motor 203 of the motor blower unit 15 is shown in FIG. 2.

As best shown in FIG. 3, the cube unit 15 is formed with outer support members which are connected together and to which various panels of the unit can be connected. For example, rear frame members relative to FIG. 3 comprise a top transverse member 14 which is connected to a vertical member 15 which connects to a horizontal member 16 which in turn connects to a vertical member 17 which is connected at its upper end to the horizontal member 14. The left forwardly surface of the cube is defined by angle irons which have surfaces 19, 20, 21 and 18 and the top surface is defined by the angle iron surfaces of 14, 18, 27 and 22. The lower surface of the cube is defined by angle irons 16, 20, 29 and 24 and the right rear surface relative to FIG. 3 is defined by the angle iron surfaces 22, 23, 26 and 24. One of the surfaces is for mounting the motor and the output panel and this is defined by the angle irons 27, 28, 29 and 30. This surface also has a pair of transverse cross-members 31 and 32 which are joined by short vertical members 33 and 34 a shown so as to provide a strong supporting surface for the motor and blower. As shown in the exploded view of FIG. 3 top and bottom panel members 38 and 36 can be connected to the top and bottom surfaces of the cube by set screws which pass through aligned openings in the panels and in the angle iron members of the cube. A side member 37 can also be mounted to a selected side of the cube by set screws. The output panel 39 is connected to the side of the cube which includes the reinforcing members 31, 32, 33 and 34 so that its output opening 41 joins to the output opening of the motor blower unit, not shown in FIG. 3. A control panel unit 43 is selectively connectible by its flange 44 to one surface of the cube by set screws. As shown in FIG. 1, the control panel 43 is connected to a surface of the cube by set screws which pass through openings in the flange 44 and join the control panel to the angle iron members 18, 19, 20 and 21.

A humidifier connecting member 47 is formed with a central opening 40 and is connected to the angle iron members 14, 15, 16, and 17 by set screws. Connecting member 46 of generally angle iron configuration is connectible to the cube 15 on one edge so as to provide a connecting and supporting surface for the humidifier unit 11 as shown, for example, in FIGS. 1, 2, 4 and 6.

The humidifier unit 11 as best shown in FIGS. 2 and 4 has a top wall 101 and a bottom wall 102 and sidewalls 103, 104, 105, 106, as shown. A connecting inverted U-shape flange 107 is connected to the top wall 101 and is receivable over the connecting member 46 of the cube member 15. A locking detachable clamp or clasp 111 shown in FIGS. 2 and 11 connects the lower end of the humidifier unit 11 to the lower end of the cube unit 15. The bottom unit 36 of the cube unit 15 carries a plate 116 with a lug 117 and the lower plate 102 of the humidifier unit 11 carries a plate 112 with a pivoted handle 113 and a bail 114 so as to selectively lock the bail 114 to the member 117.

The rear plate 102 of the humidifier unit 11 is formed with an opening 121 as shown in FIGS. 2 and 4 so as to provide an intake for the incoming air to the unit. Mounted inside the humidifier unit 11 is the moisture supplying unit 122 which has an upper tank 123 to which water is supplied through a pipe 124 which is connected to a solenoid valve 126 for turning the water on and off. A supply water conduit 127 is connected to the solenoid valve 126. The tank 123 is formed with a plurality of discharge openings 128 so as to allow water from the tank 123 to pass onto a porous unit 129 which allows air passing through it to pick up the water passing through the unit 129. A lower tank 131 is connected to the lower edge of the member 129 and has a discharge opening 132 which can be connected to a discharge pipe for removing excess water from the lower tank 131. An alternate arrangement is to provide a float control switch 141 mounted in the tank 131 which has a float 142 so as to close the switch 141 when the water from the tank 131 becomes too high so as to energize a pump 143 which has a discharge pipe 144 for pumping the water to a suitable drain. This is shown in FIG. 4.

Figure 12:
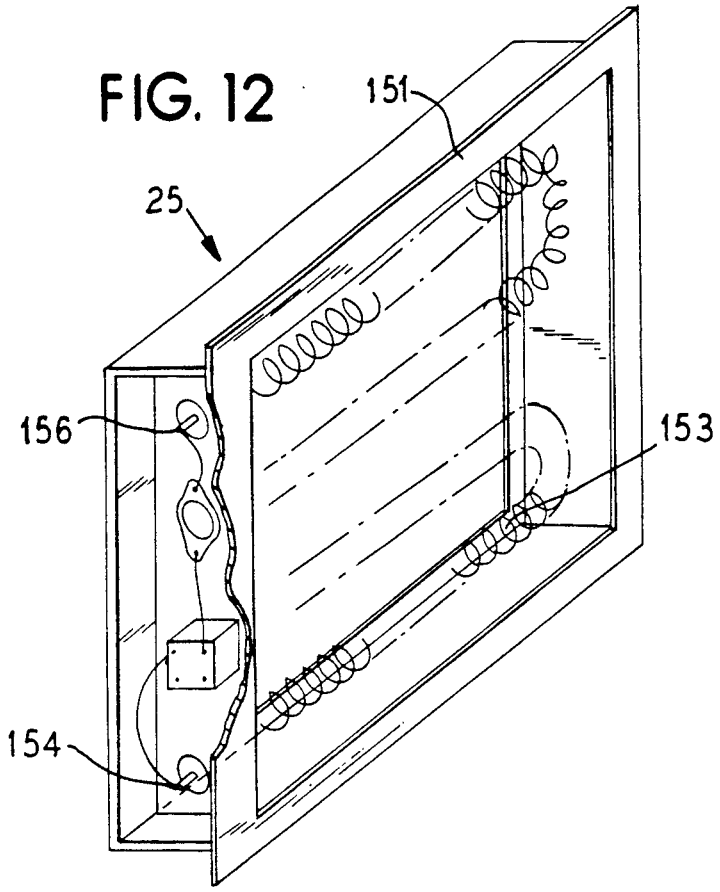
FIG. 12 is a perspective view of a pre-heater.

As best shown in FIGS. 2 and 12, a preheat unit 25 may be mounted to the input panel 102 of the humidifier 11 by suitable set screws so as to preheat the air entering the unit. The unit 25 is formed with a generally rectangularshaped flange 151 and has an input opening 152 which allows the input air to pass over a heater 153 which has output leads 154 and 156 which can be connected to a suitable power source so as to provide preheat for the air entering the unit.

The unit 10 may be mounted to a surface such as the ceiling of a condominium by a hanger hooks 51 and 52 as shown in FIGS. 1 and 6. FIG. 10 illustrates a bolt 131 which passes through an opening in the bracket 51 so as to attach the unit 10 to a suitable supporting surface.

Figure 5:
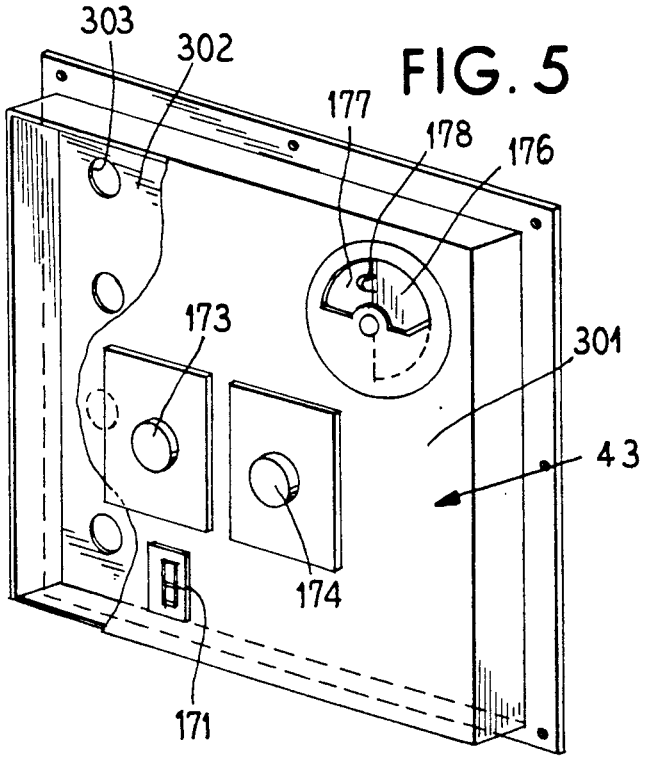
FIG. 5 is a perspective view of the control panel.

The motor blower 151 is illustrated in FIGS. 1 and 2 and the blower may comprise a two speed centrifugal blower which has a center inlet 152 and an output tube 153 which connects to the plate 39 so that the outlet 153 mates with the opening 41 in the plate 39. A duct 161 may be connected to the outlet 153 if desired. The motor blower 151 is connected to the frame members 31 and 32 illustrated in FIG. 3. The panel member 43 has an on and off switch 171 and an input cord 172 and high and low speed variable switches 173 and 174. As shown in FIGS. 1 and 5, a crescent-shape opening 176 is formed in the control panel 43 which can be completely or partially covered by a rotating member 177 so as to selectively allow ambient air to enter into the cube unit 15. A tab 178 can be manually moved so as to open the crescent-shape opening 176 completely or to close it off completely or to adjust the rotating cover member 177 to any desired position. This allows the mixing of ambient air with the humidified air which has passed through the humidifier.

Figure 13:
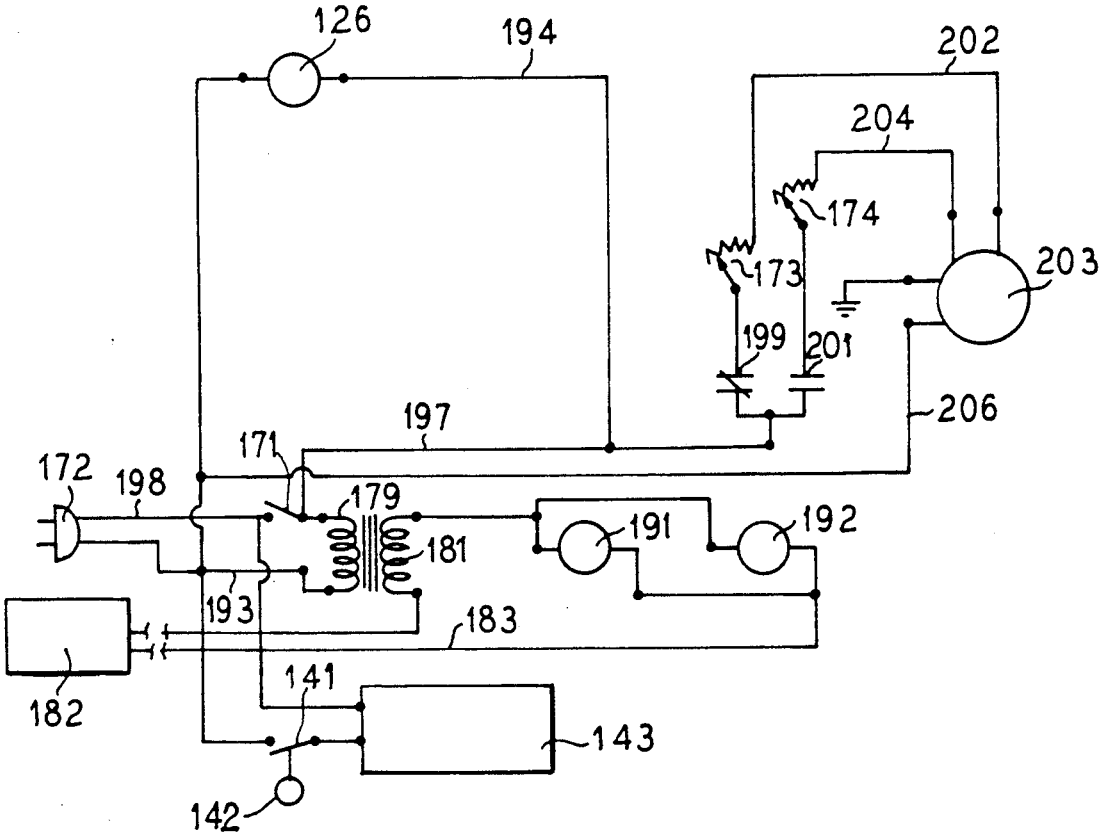
FIG. 13 is the electrical schematic for the humidifier.

The panel 43 has a front cover 301 and a back plate 302 as shown in FIG. 5. Openings 303 are formed in back plate 302 to allow air to enter the unit 15. As shown in FIG. 13, power is supplied to the power line 172 which has one side 193 connected to the primary 179 of a transformer which has its other side connected to the on-off switch 171 which connects to the other side 98 of the input power cord 172. The secondary 181 of the transformer has one side connected to a humidistat 182 which may be mounted inside the unit 10 or may be externally mounted and connected to the unit. The input power may be 120 volts AC and the output across the secondary 181 may be 20 volt AC. Line 183 from the humidistat 182 is connected to relays 191 and 192 which have their other sides connected to the secondary 181. The lead 193 of the input power source is supplied to the water solenoid 126 which has its other side 194 connected to lead 197 which connects to the on-off switch 171 which is connected to the other power lead 198. Lead 197 is also connected to relay contacts 199 and 201 which are respectively controlled by relays 191 and 192. Relay contacts 199 pass current through high speed variable speed control 173 which is connected to lead 202 which connects to the high speed winding of the motor 203. Relay contacts 201 pass current through the low speed variable control 174 which is connected to lead 204 which is connected to the low speed winding of the motor 203. The humidistat 182 activates the low or high speed relays 191 or 192 depending how much moisture is required to be supplied by the humidifier 10. If a large amount of water must be added the high speed relay 191 is energized and if a smaller amount is required the low speed relay 192 is energized. The common output lead 206 of motor 203 is connected to lead 193. The optional float control pump 143 is connected across power leads 193 and 198 through float control switch 142.

In operation, when the on-off switch 171 is closed, the water solenoid 126 is energized to open the water supply valve to supply water to the upper tank 123 of the humidifier and water passes down over the unit 129. Simultaneously when switch 171 is closed, the motor 203 will be energized either through its high speed winding or its low speed winding depending upon whether the relay contacts 199 or 201 are closed. The preheater unit 25 will also be energized if this optional unit is installed when the on-off switch 171 is closed and the preheated air will pass over the moisture adding unit 129 of the humidifier and into the cube 15 where it will be distributed by the blower motor 151 to the output plenum 161.

It is to be realized that the advantage of the cube 15 is that the output opening 41 can be mounted so that it discharges air out of any of the four sides of the cube or out of the top or bottom of the cube. Thus, by selectively moving the panels of the cube 15 shown in FIG. 3 to any orientation, the output opening 41 can be on any side of the cube. The motor and blower 151 are moved with the output opening 41. The humidifier unit is connected to one of the four horizontal sides of the cube and the remaining sides of the cube are covered by the illustrated panels and the control panel 43. Thus, a very large number of orientations of the output opening 41 can be obtained.

Also, as shown in FIGS. 7, 8 and 9, the orientation of the opening 41 can be selected as desired. Also, the control panel 43 can be moved to any desired side of the cube 15 so that it is convenient for the operation of the unit.

The use of a centrifugal two speed blower motor results in substantial advantages. The motor may be water proofed by using a stainless proof shaft and by sealing the bearings from exposure to water vapor.

The cube construction allows the unit to be rotated to any desired orientation.

Although the invention has been described with respect to preferred embodiments, it is not to be so limited as changes and modifications can be made which are within the full intended scope of the invention as defined by the appended claims.

We claim as our invention:

1. A humidifier comprising, a generally hollow cube-shaped frame structure with a top, a bottom and four sides, a motor blower with an outlet which can be selectively mounted to said hollow cube-shaped frame so that its outlet can extend in the direction of the top or bottom or any of said four sides, an outlet cover member with an opening which mates with the outlet of said motor blower connected to said cube-shaped frame, a humidifying unit with an input and an output connectible to said hollow cube-shaped member so as to cover one of said four sides, and a plurality of cover members attached to the top, bottom and said four sides of said cube-shaped frame to cover the remaining top, bottom and four sides of said cube-shaped frame to cover the remaining top, bottom and four sides of said cube-shaped frame which are not covered by said outlet cover member and said humidifying unit wherein said motor blower outlet is rectangularly shaped and said outlet cover member opening is rectangularly shaped and said motor blower outlet and said outlet cover member can be oriented in selectible orientations wherein the rectangularly shaped openings extend in different directions, and wherein one of said plurality of cover members is a control panel for controlling said motor blower and said humidifying unit and said control panel can be mounted on the top or bottom or on any of said four sides not covered by said outlet cover member or said humidifying unit.

2. A humidifier according to claim 1 wherein said control panel has an adjustable opening for selectively admitting ambient air into said humidifier

3. A humidifier according to claim 1 including a preheater connectible to the inlet of said humidifying unit.

4. A humidifier according to claim 1 including clamp means for attaching said humidifying unit to said cube-shaped frame.

5. A humidifier according to claim 1 including a humidistat connected to said humidifying unit and said motor blower to control them.

6. A humidifier according to claim 1 wherein said humidifying unit includes a solenoid controlled water valve for supplying water thereto.

7. A humidifier according to claim 1 wherein said humidifying unit includes an outlet pan and a float switch mounted in said outlet pan, and a pump controlled by said float switch so as to remove water from said outlet pan.

* * * * *